US006164186A

United States Patent [19]

Contat

[11] Patent Number: 6,164,186

[45] Date of Patent: Dec. 26, 2000

[54] JACK FOR BOLTING AND UNBOLTING

[75] Inventor: Bernard Contat, Scionzier, France

[73] Assignee: Etablissements Contat Freres, Scionzier, France

[21] Appl. No.: 09/154,118

[22] Filed: Sep. 16, 1998

[30] Foreign Application Priority Data

Sep. 18, 1997 [FR] France ..... 96 11914
Nov. 20, 1997 [FR] France ..... 97 14805

[51] Int. Cl.[7] ..... F15B 15/26

[52] U.S. Cl. ..... 92/21 MR; 92/24

[58] Field of Search ..... 92/21 R, 21 MR, 92/24, 13.6

[56] References Cited

U.S. PATENT DOCUMENTS

| | | | |
|---|---|---|---|
| 2,434,828 | 1/1948 | Ashton et al. | 92/21 MR |
| 2,655,058 | 10/1953 | Eschenburg et al. | 92/13.6 |
| 4,240,332 | 12/1980 | Deutsch | 92/21 MR |
| 4,323,001 | 4/1982 | Masclet et al. | 92/21 MR |

FOREIGN PATENT DOCUMENTS

| | | | |
|---|---|---|---|
| 47 260 | 3/1937 | France . | |
| 2231873 | 12/1974 | France | 92/13.6 |
| 2 534 985 | 4/1984 | France . | |
| 21 43 712 | 3/1973 | Germany . | |

*Primary Examiner*—F. Daniel Lopez
*Attorney, Agent, or Firm*—Fay, Sharpe, Fagan, Minnich & McKee, LLP

[57] ABSTRACT

A jack (1) has a jack body (2) with a peripheral wall (3) which forms a jack chamber (4). Two pistons (5*a*, 5*b*) attached to piston rods (6) are movably mounted in the jack chamber. The jack (1) has an automatic locking section (MV) to lock the two pistons (5*a*, 5*b*) and their respective rods (6) in at least one of two extreme positions. The locking is done automatically during the movement of the pistons (5*a*, 5*b*) by locking balls (11*a*, 11*b*) which move in locking grooves (10*a*, 10*b*) in the piston (6). There is also a manual unlocking device (MDV) connected to the pistons (5*a*, 5*b*) through unlocking rods (21). The manual unlocking device (MDV) is attached to two unlocking collars (7*a*, 7*b*) which rotate to unlock the piston (5*a*, 5*b*) and piston rod (6). The rotation, in turn, moves adjustment screws (23) to displace the unlocking rods (21) along their axes.

12 Claims, 6 Drawing Sheets

JACK FOR BOLTING AND UNBOLTING

BACKGROUND OF THE INVENTION

The present invention is directed to a mechanically operated jacks and, more particularly, an improvement for a jack in which the extreme positions of its piston are automatically locked and can be unlocked manually or automatically.

Traditionally, there are many different types of jacks, for example, hydraulic jacks, pneumatic jacks, and others, which are used for various applications. These jacks frequently encounter problems associated with their particular utilization, such as, when the operating energy of the jack fails, for example, a pressure drop in a pneumatic jack, so that the piston/piston rod unit becomes motionless. Likewise, in certain jacks, a drop in gas pressure automatically locks the piston in position and the piston cannot be unlocked or moved until the necessary operating energy is reestablished.

Further, the different devices in existence which allow locking of the piston and its rod usually require additional pieces or meticulous machining of some of its component parts, making their manufacture delicate, long, and onerous.

Thus, it is the object of the present invention to resolve the aforementioned problems with the aid of simple means, which are reliable and less onerous. The present invention contemplates a new and improved jack which can be unlocked in its extreme position and which can be unlocked easily either manually or automatically in case of a breakdown.

SUMMARY OF THE INVENTION

In accordance with the present invention, there is provided a jack body having a peripheral wall which forms a jack chamber in which at least one piston is integral with a piston rod is displaced. The jack includes locking means for locking the piston and its rod in at least one of its extreme positions. The locking takes place automatically based on the movement of the piston.

In accordance with a more limited aspect of the invention, the locking means includes locking devices which slide along at least one locking groove of the piston rod. The locking devices are preferably balls arranged annularly around the piston rod in ball housings of a ferrule, which is integral with the body of the jack. The balls move radially along the locking groove of the rod when the piston(s)/piston rod(s) set(s) reaches an extreme position.

In accordance with a more limited aspect of the invention, the locking means allows the piston/piston rod set to lock in the two extreme positions and the jack includes two pistons which move relative to each other when they are urged by a resilient contact means, such as a spring. The pistons are located apart from each other and are urged against two stops. The piston rod includes two locking grooves which accept associated locking balls.

In accordance with another more limited aspect, manual locking means are provided.

In accordance with a more limited aspect of the invention, the piston or pistons move longitudinally along the piston rod. The manual unlocking means includes at least one drive member which is connected to the piston or pistons and moves the piston or pistons longitudinally.

In accordance with a more limited aspect of the invention, the drive member or members include two unlocking collars which are arranged on the outside and at each extremity of the body of the jack. Each collar can be activated by rotation through manual action on the part of a user. The unlocking of the collars against one another initiates the displacement of the corresponding piston. Movement of the connection means, i.e., unlocking rods or shafts, forces the piston to unlock itself against the action of the spring. The unlocking rods or shafts are displaced along their axes by an adjusting screw activated by rotation of the corresponding unlocking collar.

In accordance with a more limited aspect of the invention, the dimensions of the elements of the locking means and the unlocking means are selected such that the unlocking of the set of piston/piston rod requires a rotational angle from 0 to 180°.

According to another aspect, the unlocking collars contain a torsion spring which permits the resetting of the collar to its initial position after it has been actuated.

According to another aspect, the jack is a pneumatic jack and compressed air flows in one or more hollow tubes in the jack. The tubes are longitudinally located through the chamber of the jack.

A principle advantage of the invention is a jack which has simple, reliable, and less onerous parts that can be locked in its extreme positions automatically and can be unlocked easily either manually or automatically.

Still further advantages of the present invention will become apparent to those of ordinary skill in the art upon reading and understanding the following detailed description of the preferred embodiments.

BRIEF DESCRIPTION OF THE FIGURE

The invention may take form in various components and arrangements of components, and in various steps and arrangements of steps. The drawings are only for purposes of illustrating a preferred embodiment and is not to be construed as limiting the invention.

FIG. 6*a* represents schematically the locked piston, the piston and its rod;

FIG. 6*b* represents the displacement of the piston under action of the unlocking collar;

FIG. 6*c* illustrates the exit of the locking member from the piston rod; and, FIG. 6*d* represents the displacement of the piston rod leaving its extreme position.

DETAILED DESCRIPTION OF THE PREFERRED EMBODIMENTS

Figure 1:
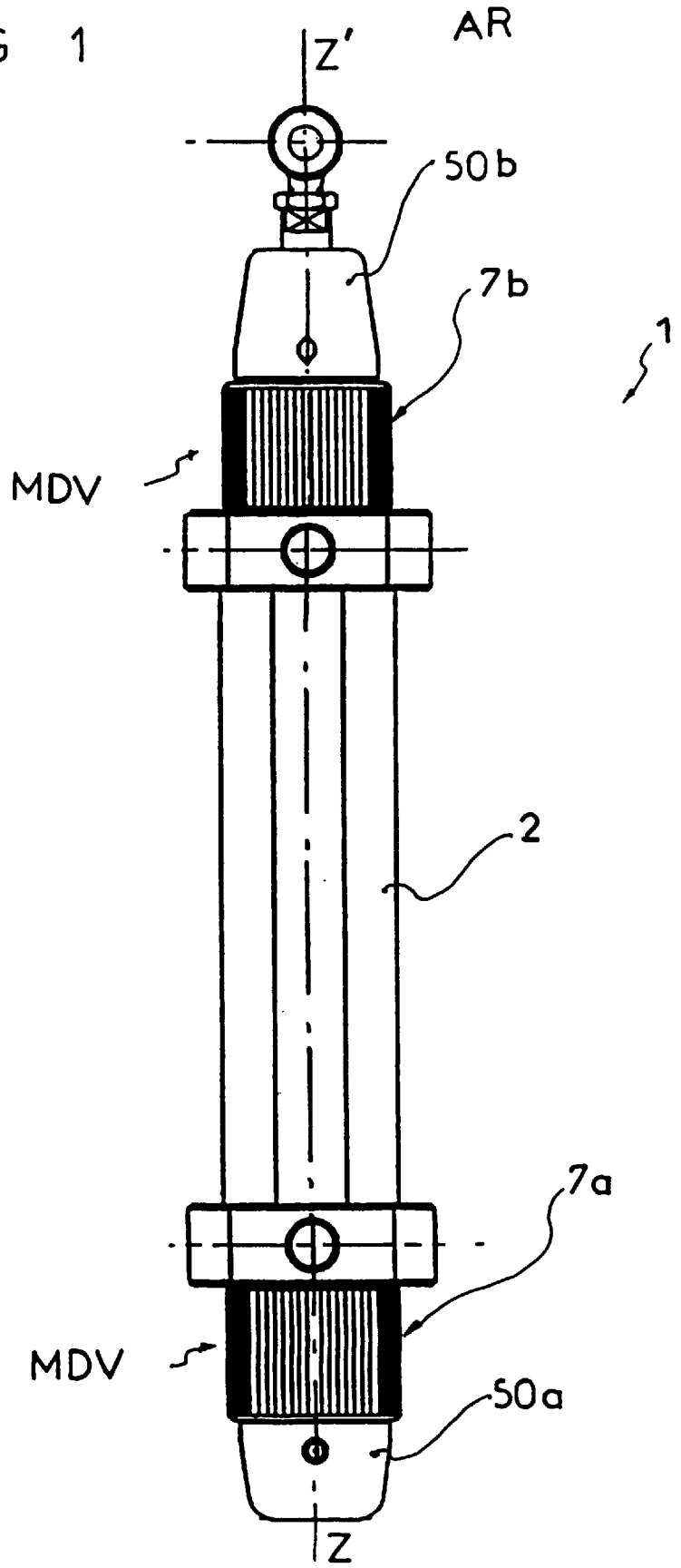
FIG. 1 is a side view of the jack in its assembled condition.
Figure 2:
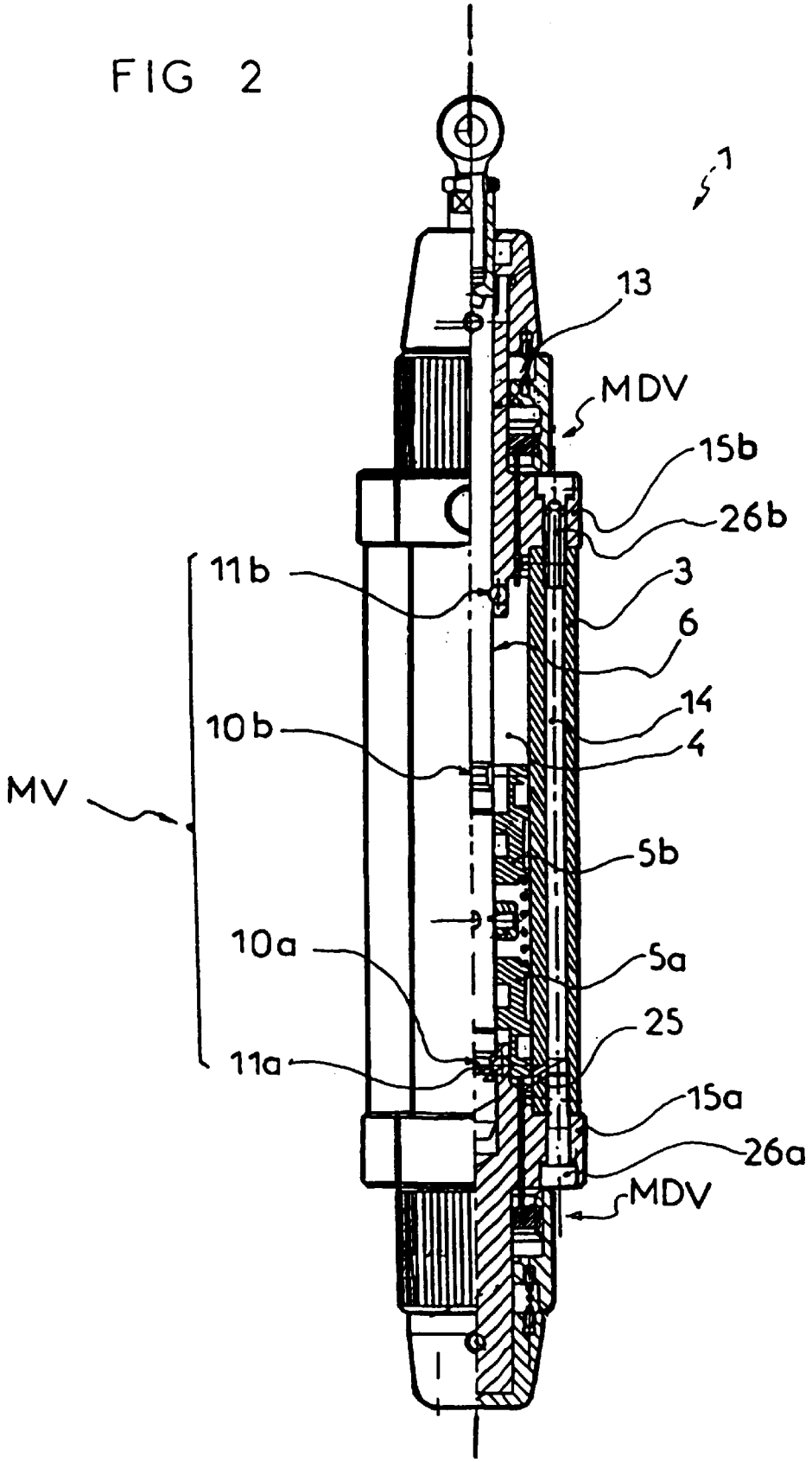
FIG. 2 illustrates a side view of the jack with half of the jack longitudinally in cross section.

With reference to FIGS. 1 and 2, a jack 1 includes a jack body 2 defined by a peripheral wall 3 forming a jack chamber 4 in its interior. At least one piston 5, which is integral with a piston rod 6, momves in the jack chamber.

The jack 1 includes a locking means MV which locks the piston 5 and its interconnected rod 6 in its two extreme positions automatically.

It is to be appreciated that even though the preferred embodiment of the jack 1 according to the invention describes locking in two extreme positions of the piston/piston rod combination, other locking and unlocking means can be provided, such as those described hereinafter for only one of the extreme positions.

With continuing reference to FIGS. 1 and 2, preferably the jack 1 is a pneumatic jack in which the piston is moved by compressed air flowing in a section of the jack chamber 4. It is to be appreciated that the present locking and unlocking device can also be used with a hydraulic type jack or any other type jack.

Turning to FIG. 2, the locking means MV includes locking members 11*a*, 11*b* which move into a locking groove 10*a*, 10*b* of the piston rod 6 when the piston rod 6 is positioned in an extreme position thus locking the piston rod 6. The piston rod 6 includes two locking grooves 10*a*, 10*b* which allow the piston rod 6 to lock in either of two extreme positions. The locking members preferably include two locking ball units 11*a*, 11*b* which position themselves, respectively, in locking grooves 10*a*, 10*b* when the piston/piston rod combination is positioned in one of the two extreme positions.

In the preferred embodiment, the first set of the locking balls units 11*a* includes four balls, arranged on a front ferrule 15*a*; the balls 11*b* of the second unit are, respectively, arranged on the rear ferrule 15*b*. The rear ferrule 15*b* includes an internal opening 13 into which the piston rod 6 slides along its longitudinal axis ZZ'. The balls of the annular peripheral wall displace radially to become lodged in the groove 10*b* in order to lock the rod 6. Likewise, the front ferrule 15*a* includes, at its rear extremity, a hollow cylindrical casing 16 into which the end of the piston rod 6 is inserted. The balls 11*a* of the first unit are arranged annularly in the peripheral wall to allow movement in radial direction insuring the locked position of the piston rod 6, while the balls 11*a* slide in the locking groove 10*a*. It is to be appreciated that the locking ball units 11*a*, 11*b* may include a different number of balls, for example two balls diametrically opposed.

Figure 3A:
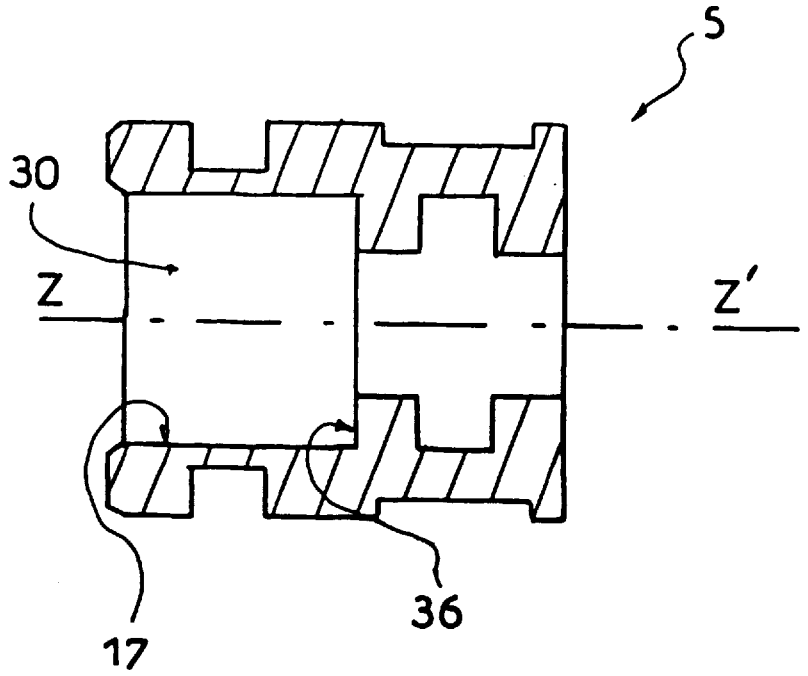
FIG. 3*a* represents the piston body of one of the pistons in longitudinal cross section.
Figure 3B:
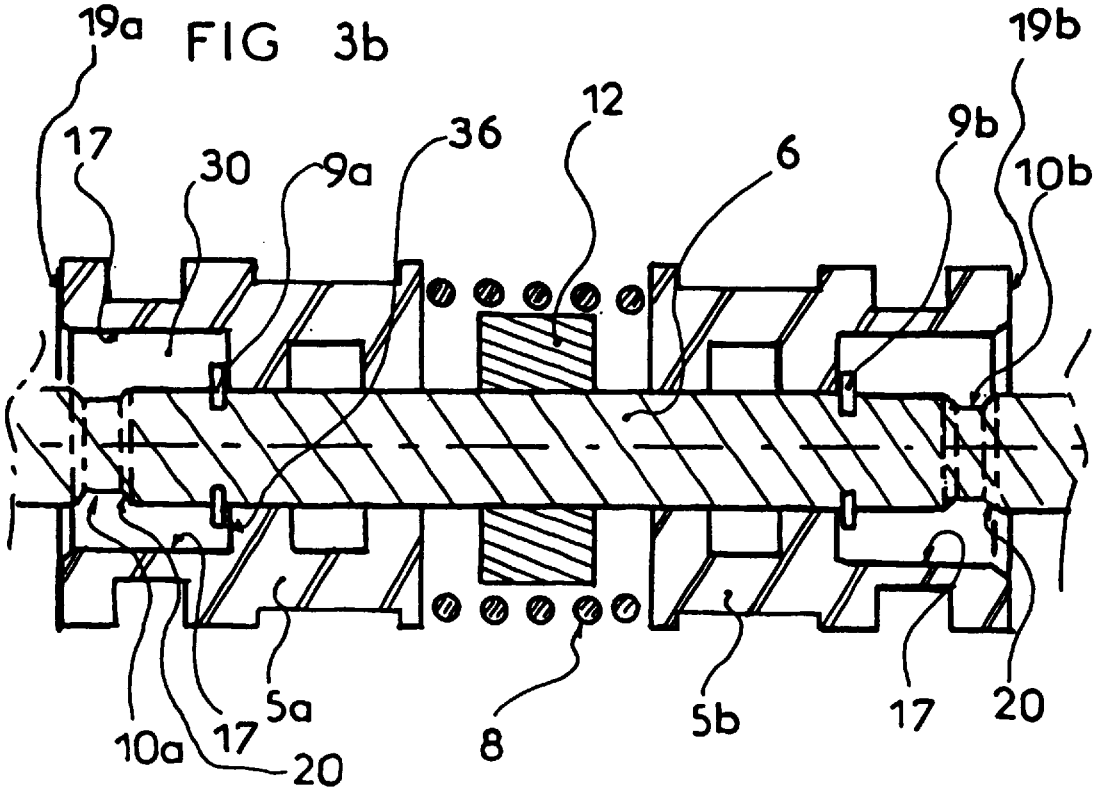
FIG. 3*b* illustrates the piston/piston rod set in longitudinal section.

Turning to FIGS. 3*a* and 3*b*, the radial movement of the locking organs 11*a*, 11*b* in their respective grooves 10*a*, 10*b* is obtained via action of the piston 5, 5*a*, 5*b*. In order to be able to lock in the two extreme positions, the jack 1 includes two pistons 5*a*, 5*b* supported by the piston rod 6. Each presents a support surface which includes the internal peripheral wall 17 of an opening 30 located, respectively, at the front or rear end where the surface interacts with the balls 11*a*, 11*b* in order to provoke their radial movement toward the groove 10*a*, 10*b* of the piston rod 6.

Figure 6A:
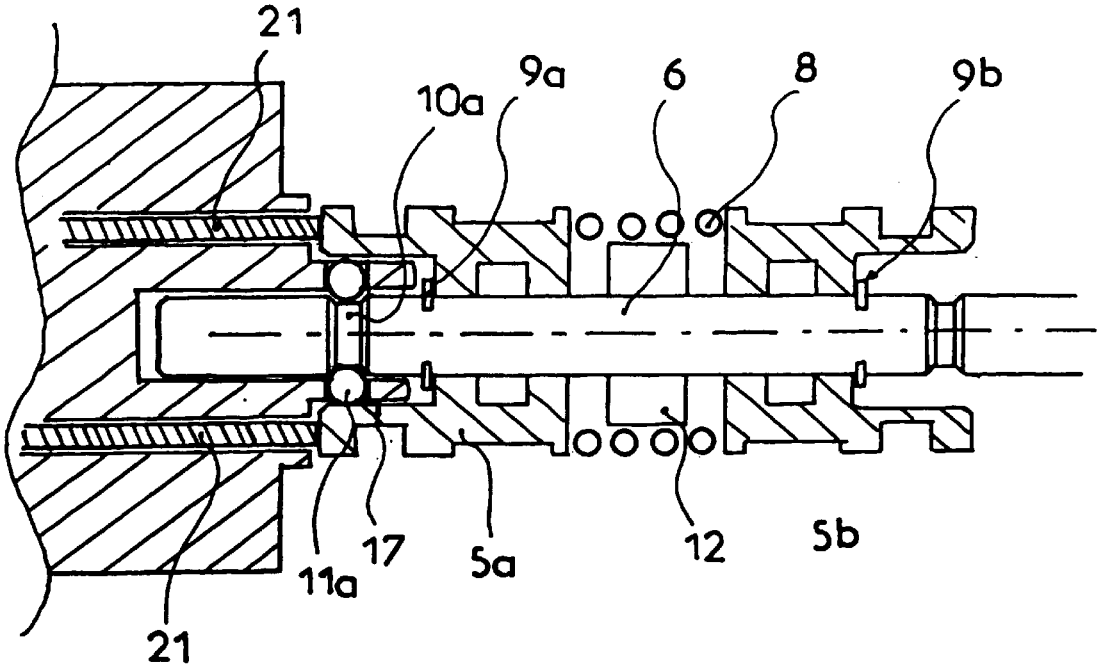
FIGS. 6*a*–6*d* illustrate schematically the unlocking of the piston/piston rod set, with the body of the jack omitted for simplicity of illustration.
Figure 6B:
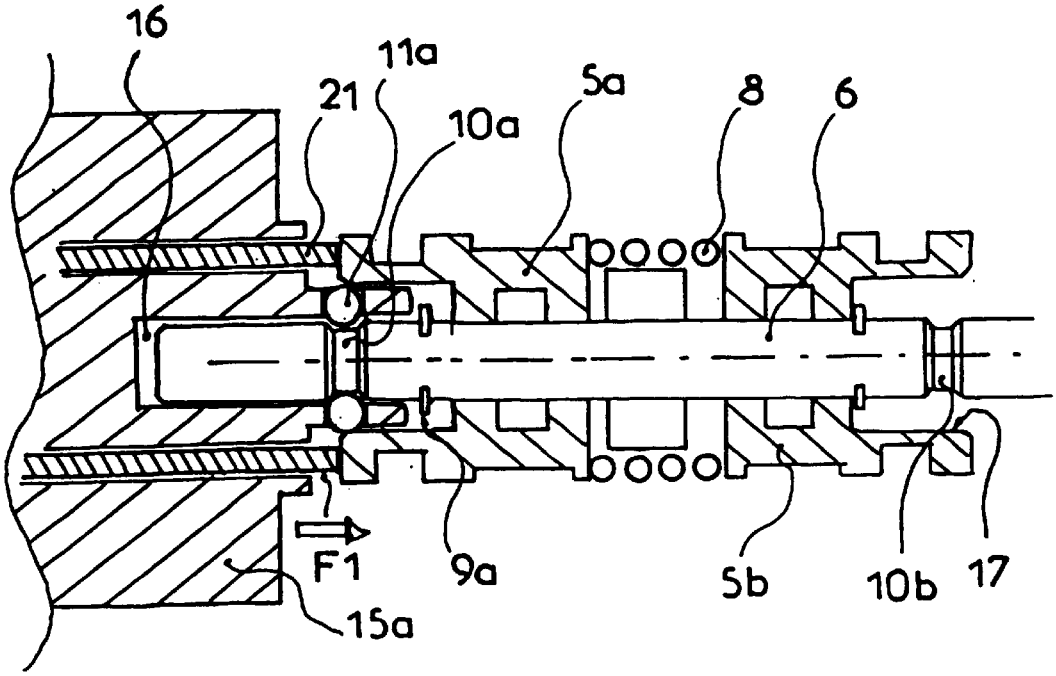

Looking now to FIG. 6*a*, the balls 11*a* are maintained by the support surface 17 of the first piston 5*a* in the groove 10*a* of the piston rod 6 when the piston/piston rod set is one of its extreme positions. The rod 6 and its pistons 5*a* are then locked. In the other extreme position, the locking is insured in a similar manner by the second piston 5*b*, the second groove 10*b*, and the second set of balls 11*b*.

In order to permit unlocking, the two pistons 5*a*, 5*b* glide toward each other along the longitudinal axis ZZ' of the piston rod 6 while they press against resilient compression means, preferably a spring 8, which is located between them. The two pistons 5*a*, 5*b* are urged apart until they engage, respectively, two stops 9*a*, 9*b* one on a front wall of the furnished piston 5*a* and one on a rear wall of the rear piston 5*b* where they are supported when the piston/piston rod combination is unlocked. As seen in FIG. 3*b*, in a position which is called the initial position, the front and rear walls are the end wall 36 of a well or recess 30. Based on this, when the jack is in a locked position, as is illustrated in FIG. 6*a*, the introduced pneumatic pressure initiates the longitudinal movement of the piston 5*a* against the action of the spring 8 until such point when the support surface 17 of the piston 5*a* no longer cooperates with the locking members 11*a*, which are released, unlocking the jack 1 and the two pistons 5*a*, 5*b*, return their initial position.

As seen in FIG. 3*b*, the release of the locking members 11*a*, 11*b* is assisted by the locking grooves 10*a*, 10*b* of the piston rod 6 including an inclined annular slope or chamfer 20.

Figure 4:
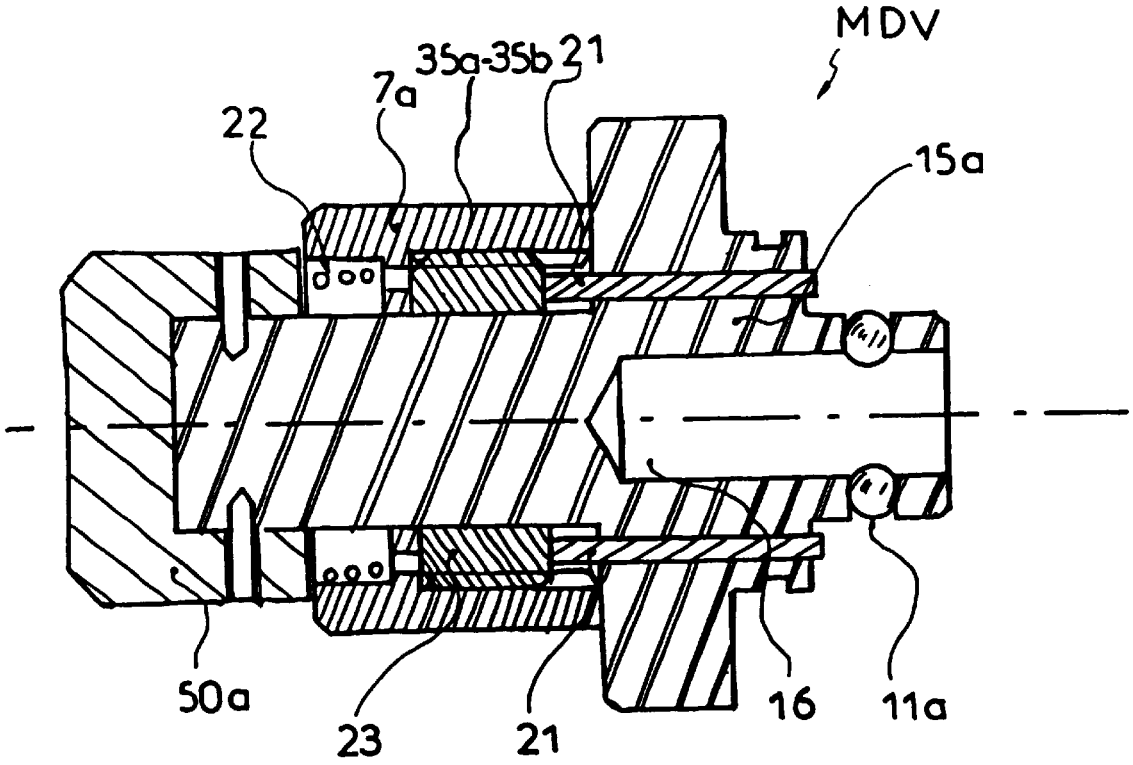
FIG. 4 illustrates the unlocking mechanism of the piston and piston rod in section.

Turning to FIG. 4, the jack 1 includes manual unlocking means MDV shown as control members 7*a*, 7*b* which initiate the longitudinal displacement of the piston or pistons 5, 5*a*, 5*b* as described previously, with the aid of connection means, such as unlocking rods or shafts 21. In the manual unlocking means MDV, the control members 7*a*, 7*b* include two rotating unlocking collars 7*a*, 7*b* arranged on the outside and at each extremity of the body of the jack 2. Each collar 7*a*, 7*b* can be rotated via manual action on the part of the user. The rotation of one or other of the unlocking collars initiates the displacement of the corresponding piston 5*a*, 5*b* through the movement of the unlocking rod or shafts 21 which force the piston 5*a*, 5*b* to unlock against the pressure of the spring 8. Sleeves or rods 21 are displaced along their longitudinal axis because threaded member 23 is advanced by rotation of the corresponding unlocking collar 7*a*, 7*b*.

Figure 6C:
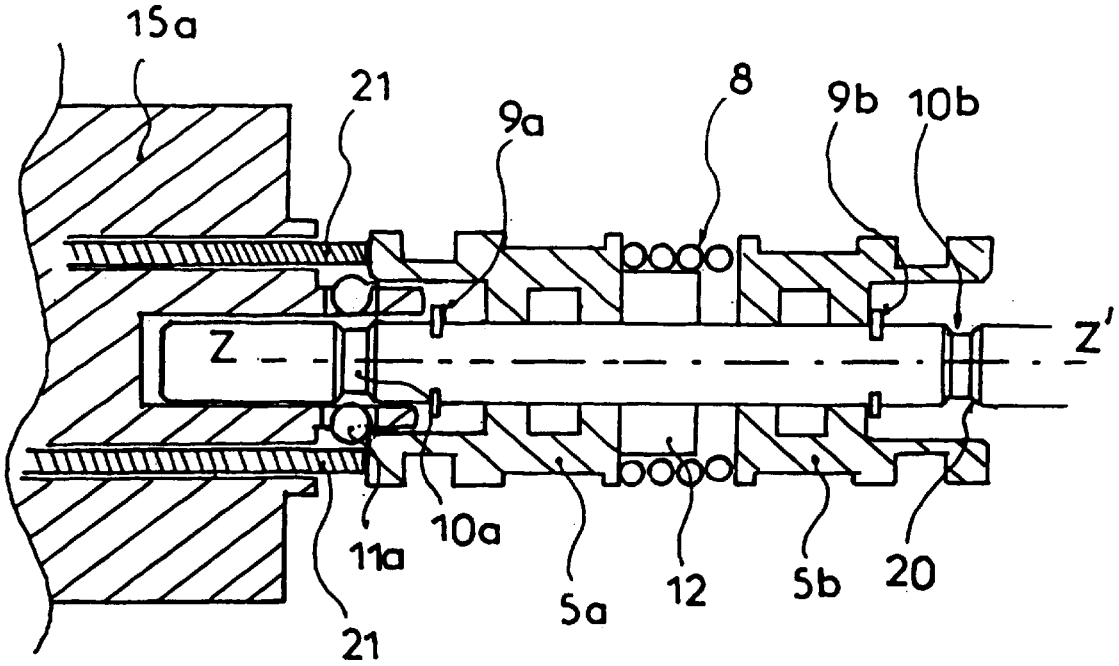
Figure 6D:
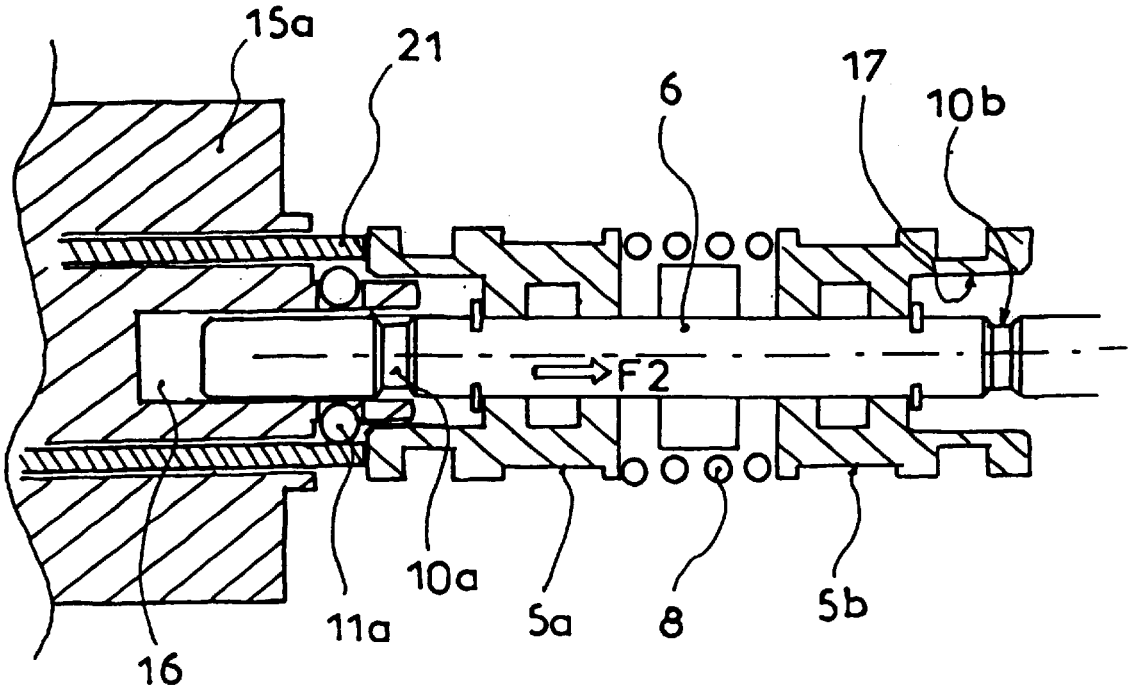

Turning to FIGS. 6*a*–6*d*, the rotation of the collar 7*a* moves in a known manner, for example, by cooperation of an internal thread 35*a* of the collar and external thread 35*b* of the adjustment screw (FIG. 4). The displacement of the adjustment screw 23 is along the longitudinal axis ZZ' of the unlocking sleeves or rods 21 in the direction indicated as arrow F1 in FIG. 6*b*. The piston 5*a* is unlocked by releasing the locking element 11*a*, as shown in FIG. 6*c*. Following that, the unlocked piston rod 6 moves in a direction of F2 which permits the piston/piston rod combination to return to its initial position by moving it in the longitudinal direction, as shown in FIG. 6*d*. It should be noted that the jack 1 includes two end stops 50*a*, 50*b*, respectively, integral with the rear and front ferrules 15*a*, 15*b* in such a manner so as to block the unlocking collars in either longitudinal direction.

The jack 1 has two rod sets or sleeves 21, one at each of its extremities, which are positioned in a diametrically opposed location relative to the axis ZZ' and parallel thereto. The rods or sleeves 21 are in abutment against the front and rear extremities 19*a*, 19*b* of the respective pistons 5*a*, 5*b*. It is important to note that the piston rod 6 includes a central stop 12 situated between the stops 9*a*, 9*b* and which is arranged between the two pistons 5*a*, 5*b* in order to limit the travel approaching each other.

According to the preferred embodiment of the jack, he dimensions of the various elements which make up the locking means MV and the manual unlocking means MDV such as the unlocking collars 7*a*, 7*b*, the pistons 5*a*, 5*b*, the spring 8, the adjustment screw 23, or the unlocking buttons 21, for example, are selected in such a manner that the rotation of the collar which is necessary for unlocking the piston is at an angle ranging between 0° and 180°, and advantageously is equal to 120°. The rotation amplitude of the collar can be different without going outside of the protected field of the invention; likewise, the control elements or the connection elements of the manual unlocking means MDV can be replaced by equivalent means. It should be noted that the unlocking collars 7*a*, 7*b* are advantageously equipped with a torsion spring 22 intended to invoke an inverse rotation of the unlocking collar in order to bring it back into its initial position. The same is true of the adjustment screws 23 and the unlocking push buttons 21 which are connected with it.

It should be noted that according to the preferred embodiment, the unlocking collars 7*a*, 7*b* are arranged at each extremity of the jack in such a manner so as to be able to rotate around the longitudinal axis ZZ' of said jack.

Figure 5:
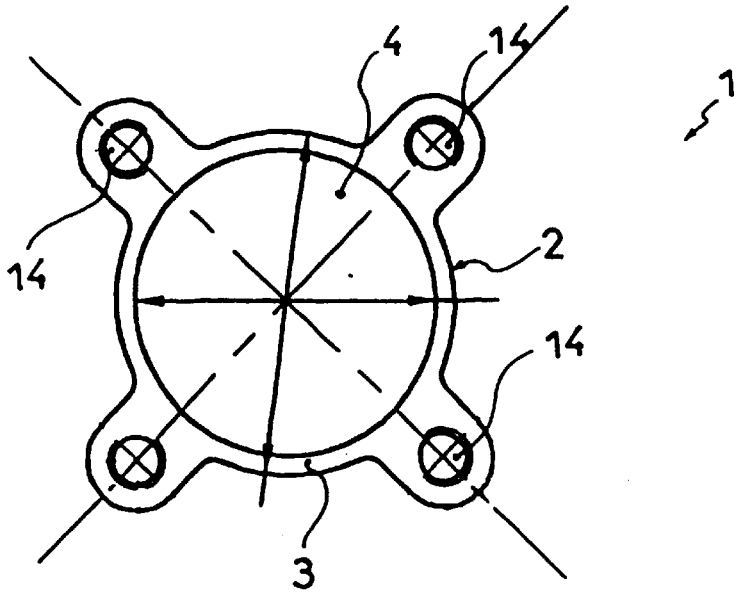
FIG. 5 illustrates the body of jack in transverse section.

In addition, as depicted in FIGS. 1 and 5, the passage of the compressed air into or out of the pneumatic jack 1 takes place longitudinally through jack in one or several hollow cylindrical tubes 14 of the body of the jack 2 arranged on the outside of the chamber 4.

According to the preferred embodiment, the number of tubes 14 amount to four and beneficially permit passage of compressed air through the front and rear ferrules 15*a*, 15*b* through connection screw 26*a*, 26*b*. One screw 26*b* is in part perforated in order to permit the flow of compressed air. It should be noted that a passage or duct 25 connects the tube 14 to the front extremity of the chamber of the jack 4 to introduce the compressed air which acts on the piston 5*a*.

It is to be appreciated that the jack could include locking means for only one of its extreme positions and thus, only one movable piston and its associated unlocking means.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A jack comprising:

a jack body with a peripheral wall which forms a jack chamber in which first and second pistons are displaced in combination with a piston rod, the pistons being movable along the piston rod and relative to each other;

a locking means for automatically locking the first and second pistons and the piston rod in first and second extreme positions of the piston rod, respectively, said locking taking place automatically in response to movement of the piston rod to either of the extreme positions, the locking means including:

first and second locking grooves in the piston rod adjacent the first and second pistons, respectively;

at least first and second locking elements which interact with the first and second locking grooves respectively, in the piston rod, the first locking element interacting with the first locking groove to lock the piston rod in the first extreme position and the second locking element interacting with the second locking groove to lock the piston rod in the second extreme position;

a resilient biasing device which urges the first and second pistons apart from each other against two stops;

first and second drive elements for longitudinally displacing the first and second pistons, respectively, longitudinally away from the first and second locking elements; and, first and second unlocking collars rotatably mounted around each extremity of the body of the jack, each unlocking collar being manually rotatable, the rotation of each of the unlocking collars causing longitudinal displacement of the corresponding locking member and piston releasing the piston rod from the corresponding locking element.

2. The jack according to claim 1, wherein:

the unlocking collars each include a torsion spring which returns the unlocking collar to its initial position after its actuation.

3. The jack according to claim 1, wherein the locking elements each include:

two or more balls positioned annularly around the piston rod in a ball housing of a ferrule which is integral with the body of the jack, and;

the two or more balls moving radially to interact with the corresponding locking groove in the piston rod under the action of a support surface of the corresponding piston when the combination of the corresponding piston and the piston rod reaches the corresponding extreme position.

4. The jack according to claim 1, wherein:

the jack is a pneumatic jack, and there is a flow passage for compressed air through one or more hollow tubes in the jack body; and, the hollow tubes run horizontally through the chamber of the jack.

5. A jack comprising:

a jack body with a peripheral wall which forms a jack chamber in which first and second pistons are disposed in combination with a piston rod, the pistons being movable along the piston rod and relative to each other;

a piston rod lock which automatically locks the piston rod in one of two extreme positions, said locking taking place automatically in response to movement of the piston rod to the one extreme position, the piston rod lock including:

a first locking groove defined in the piston rod adjacent the first piston;

a resilient biasing device which urges the first and second pistons apart from each other against opposite stops;

at least one locking element which is urged by the first piston into the first locking groove in the piston rod at the one extreme position locking the piston rod in the one extreme position;

a first annular unlocking collar located externally around and adjacent an extremity of the body of the jack, the first unlocking collar being manually rotatable around a longitudinal axis of the piston rod;

at least one unlocking member which slides parallel to the longitudinal axis of the piston rod to force the first piston against the resilient biasing device to release the locking element from the first locking groove in the piston, the at least one unlocking member being displaced along the longitudinal axis against the first piston by rotation of the first unlocking collar around the longitudinal axis.

6. The jack according to claim 5 further including:

interengaging threads on the first annular unlocking collar and the unlocking member, the interengaging threads camming the locking member to move along the longitudinal axis in response to manual rotation of the first unlocking collar around the jack body.

7. The jack according to claim 6, wherein:

the interengaging threads are dimensioned such that the unlocking member moves the first piston out of engagement with the locking elements in response to rotation of the unlocking collar through a rotational angle of less than 180°.

8. The jack according to claim 7 further including:

a spring which rotates the unlocking collar to retract the unlocking member when the unlocking collar is manually released.

9. A fluid cylinder comprising:

a cylinder body having a longitudinally extending chamber, the chamber having a passage through one end for a pumping fluid;

a piston rod slidably received longitudinally through the chamber, the piston rod defining a locking groove annularly therearound;

a first piston and a second piston slidably received in the chamber, at least one of the pistons being selectively acted on by the pumping fluid, the piston rod passing through the pistons such that the pistons are slidably mounted on the piston rod;

a spring which biases the pistons apart;

a plurality of locking members received in a ferrule portion of the housing which ferrule receives the piston rod at one extreme of movement, at the one extreme of movement the locking members being received in the locking groove and being held in the locking groove by the first piston, the spring biasing the first piston against the locking members;

an annular release collar rotatably mounted around an exterior of the body for rotation around a longitudinal axis of the body, the collar threadingly interacting with a longitudinally slidable element in the chamber such that rotation of the release collar around the longitudinal axis cams the longitudinally slidable element to slide parallel to the longitudinal axis against the first piston to move the first piston longitudinally against the biasing of the spring until the locking elements are no longer held in the locking groove by the first piston releasing the piston rod.

10. The fluid cylinder according to claim 9 wherein the annular release collar has internal threads and further including:

an annular externally threaded element associated with the longitudinally slidable element and constrained against rotation, external threads of the externally threaded element engaging internal threads of the annular release collar such that an interaction between the threads as the release collar is rotated cams the longitudinally slidable element to move longitudinally.

11. The pneumatic cylinder according to claim 9 further including an annular, torsion spring disposed between the annular release collar and an exterior surface of the body, the annular torsion spring being connected with the annular release collar and the body to provide a biasing force which biases the annular release collar to rotate in a direction which moves the longitudinally slidable element away from the first piston.

12. A method for unlocking a fluid cylinder, the method comprising:

moving two pistons together with a piston rod through a chamber formed by a peripheral wall;

resiliently biasing the pistons apart against two stops;

automatically locking the piston rod together with the pistons in one extreme position by moving at least one locking element into a locking groove in the piston rod and holding the locking element in the locking groove with one of the pistons;

manually unlocking the piston rod together with the pistons by:

manually rotating an unlocking collar located externally of and surrounding the peripheral wall to move an unlocking element parallel to an axis of rotation of the collar and against the one of the pistons mechanically displacing the one of the pistons longitudinally out of contact with the locking member to release the locking member from being held in the groove by the one of the pistons.

* * * * *